US005316162A

United States Patent [19]

Pierson

[11] Patent Number: 5,316,162

[45] Date of Patent: May 31, 1994

[54] UNIVERSALLY ADAPTABLE CHILDPROOF CAP

[75] Inventor: Theodore J. Pierson, Kinnelon, N.J.

[73] Assignee: Pierson Industries, Inc., Rockaway, N.J.

[21] Appl. No.: 976,183

[22] Filed: Nov. 13, 1992

[51] Int. Cl.[5] ..... B65D 55/02

[52] U.S. Cl. ..... 215/223; 215/206; 215/224; 220/915

[58] Field of Search ..... 215/206, 223, 225, 224; 220/915

[56] References Cited

U.S. PATENT DOCUMENTS 3,133,680 5/1964 Sliwinski .
3,802,607 4/1974 Mead .
3,866,802 2/1975 Birrell .
3,901,400 8/1975 Westfall ..... 215/221
3,934,751 1/1976 Green et al. .
3,938,710 2/1976 Bennett .
3,964,634 6/1976 Jasinski et al. .
4,121,727 10/1978 Robbins et al. ..... 215/211
4,133,448 1/1979 Balfanz .
4,325,497 4/1982 Ewald .
4,353,483 10/1982 Pehr .
4,576,315 3/1986 Vitale .
4,662,542 5/1987 Vitale .
4,779,747 10/1988 Morel ..... 215/206
5,040,691 8/1991 Hayes et al. .
5,040,694 8/1991 Gambello .
5,092,493 3/1992 Pehr .

*Primary Examiner*—Allan N. Shoap
*Assistant Examiner*—Nova Stucker
*Attorney, Agent, or Firm*—Lerner, David, Littenberg, Krumholz & Mentlik

[57] ABSTRACT

A two-piece safety cap for a container including a valve assembly having a valve rim thereon is disclosed. The safety cap comprises a collar having an inner surface and an outer surface and top and bottom portions. The collar is securably seatable on the valve rim so that the inner surface is arranged adjacent the valve rim. The bottom portion of the collar is sized and shaped so that the collar can be arranged on the valve rim regardless of the diameter of the barrel of the associated container without any interference occurring between the bottom portion of the collar and the container. The safety cap also comprises a cover adapted to be mounted between a removable position and a non-removable position on the collar. Additionally, a locking mechanism is arranged between the cover and the collar so that the cover can be selectively locked thereon.

7 Claims, 3 Drawing Sheets

UNIVERSALLY ADAPTABLE CHILDPROOF CAP

FIELD OF THE INVENTION

The present invention relates to childproof caps for preventing or hindering young children from gaining access to potentially hazardous contents within an associated container.

BACKGROUND OF THE INVENTION

Childproof caps for preventing children from gaining access to potentially dangerous products stored within different types of containers are generally known within the safety closure art. Many inventors have devoted large amounts of effort to developing childproof caps. Despite the great effort expended by such inventors, the structure and operation of known childproof caps which are adapted to prevent children from gaining access to products stored within a container have many drawbacks which render them ineffective and undesirable.

Thousands of unnecessary emergencies arise every year because of young children who accidentally come into contact with potentially dangerous products stored within various types of containers. For example, a wide variety of household products such as cleaners, insecticides, paints, cosmetic aids, and the like are stored within aerosol cans. These products are generally used by spraying them directly onto their intended target. This can be a quick and efficient way for dispensing such products from a container. However, these types of dispensers can also be extremely dangerous since many of the products can cause serious injuries if they are improperly applied to the eyes, lungs or skin of a person or an animal. This danger becomes even greater when unprotected aerosol cans are left within the reach of young children.

Many other potentially dangerous products are stored within containers which dispense such products through a valve and which have a valve rim thereon. These products include various gels, hair products such as mousse, and other cosmetic products which are retained in pressurized containers other than aerosol containers. Since these products may also be toxic, it is desirable to prevent young children from having unsupervised access to them.

As can be appreciated, the size of the barrel of the pressurized containers in which many of the foregoing products are stored can vary from relatively small to relatively large. For example, some products, such as oven cleaner, are stored in aerosol cans having a relatively large diameter barrel. On the other hand, mousse and other hair gels are often stored in a pressurized container having a relatively small diameter barrel. Despite the differences in the barrel sizes, the valve rim is generally one standard size. In particular, a well known standard size valve rim has an outer diameter of approximately 1.29 inches.

Thus, there is a great need for a universally adaptable childproof cap to prevent young children from gaining access to the potentially harmful products stored within pressurized containers having a standard sized valve rim and various sized barrels. Efforts have been made, prior to this invention, to develop childproof caps for placement over the dispensing mechanism of various pressurized cans. However, these efforts have been largely unsuccessful because the known safety caps are not universally adaptable, are too expensive to manufacture, are too difficult to remove from an associated container, or are ineffective for a variety of other reasons. Examples of known prior art safety caps having one or more of the foregoing drawbacks include U.S. Pat. Nos. 5,092,493 to Pehr; 5,040,694 to Gambello; 4,662,542 to Vitale; 4,576,315 to Vitale; 4,353,483 to Pehr; 4,133,448 to Balfanz; and 3,964,634 to Jasinski et al.

It is evident from all of the drawbacks that exist in the safety cap art, that there is a considerable need for a new and improved universally adaptable childproof cap to prevent young children from gaining access to potentially harmful contents stored within various sized pressurized containers having a standard sized valve rim thereon.

The present invention solves all of the aforementioned problems and will greatly benefit all individuals who are concerned that young children may injure themselves by dispensing various contents from pressurized containers.

SUMMARY AND OBJECTS OF THE INVENTION

One aspect of the present invention provides a safety cap for a container having a valve assembly with a valve rim thereon. The safety cap comprises a collar having an inner surface and an outer surface and top and bottom portions. The collar is securably seatable on the valve rim of the container so that the inner surface of the collar is arranged adjacent the valve rim. The bottom portion of the collar is sized and shaped so that the collar can fit on any standard-size valve rim regardless of the diameter of the barrel of the associated container without any interference between the bottom portion of the collar and the barrel of the container. The safety cap also comprises a cover which is adapted to be mounted on the collar in either a removable position or a non-removable position. Locking means are also provided for selectively locking the cover on the collar.

In a preferred arrangement, the safety cap comprises alignment means for providing an indication when the cover is arranged in the removable position and the non-removable position with respect to the collar. In another preferred arrangement, the collar comprises a lower lip circumferentially arranged on the inner surface thereof. The lower lip is adapted to engage the valve rim when the collar is mounted thereon so that the collar cannot be readily removed therefrom.

It is also desirable for the collar of the present safety cap to comprise a circumferentially arranged groove wherein the groove is sized and shaped to receive a portion of the cover therein. It is also desirable according to this aspect of the present invention for the collar to comprise recess means arranged on the outer surface thereof so that the cover can be mounted thereon and removed therefrom. Most preferably, the cover comprises a ridge and a projection wherein the ridge extends from the inner surface thereof and is adapted to be mounted within the groove of the collar. The projection is preferably sized and shaped to fit within the recess means of the collar. It is desirable according to this aspect of the present invention for the cover to be rotatable on the collar so that the projection can rotate into the groove to lock the cover onto the collar.

Another aspect of the present invention provides alignment means for providing an indication when the cover is arranged in the removable position and the non-removable position with respect to the collar. In a particularly preferred arrangement, the alignment means comprises a plurality of distinguishing marks arranged on the outer surface of the collar and the cover to indicate when the projection of the cover is aligned with the recess of the collar so that the cover can be placed on the collar and removed therefrom.

Accordingly, it is an object of the present invention to provide a universally adaptable childproof safety cap having a separate collar and cover which will effectively prevent young children from gaining access to potentially harmful products stored within containers.

It is another object of the present invention to provide a universally adaptable childproof safety cap which can be commercially manufactured at a low cost.

It is another object of the present invention to provide a universally adaptable childproof safety cap which can be commercially marketed apart from the containers which store the potentially harmful products.

It is another object of the present invention to provide a universally adaptable childproof safety cap having a collar which can be seated on a valve rim of various containers regardless of the diameter of the barrel of the associated containers without any interference between the bottom portion of the collar and the barrel of the container.

It is yet another object of the present invention to provide a childproof safety cap which effectively prevents young children from gaining access to products stored within a container but is simple for an adult to remove from the container.

These and other objects of the present invention will be more clearly understood when read in conjunction with the detailed description and the accompanying drawings which follow.

DETAILED DESCRIPTION OF A PREFERRED EMBODIMENT

A preferred embodiment of the present invention will now be described with reference to FIGS. 1-7. The childproof safety cap generally designated 10 includes a protective cover 12 and a collar 14.

Figure 2:
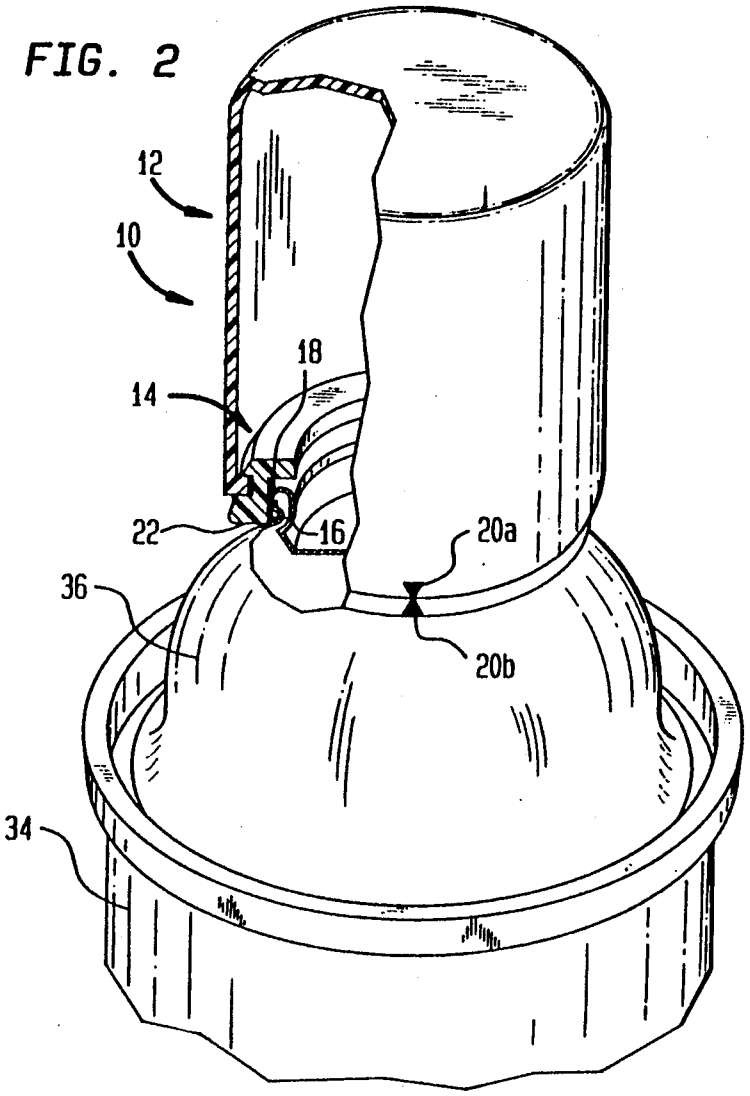
FIG. 2 is a perspective partial cross-sectional view of the childproof cap shown in FIG. 1 assembled on a valve rim of a container having a relatively large barrel.
Figure 1:
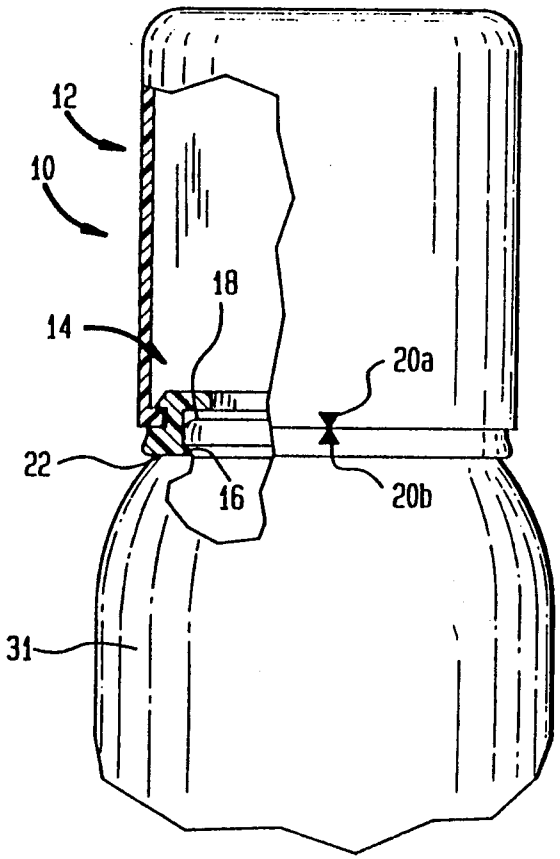
FIG. 1 is a side partial cross-sectional view of one embodiment of the childproof cap of the present invention assembled on a valve rim of a container having a relatively small barrel.

As shown in assembled form in FIGS. 1 and 2, the safety cap 10 is universally adaptable to fit on a standard sized valve rim regardless of the size of the barrel of an associated container. Thus, the unique structure of the collar 14 permits it to be mounted on either a small barrel container 31, such as a container for hair care products, or a large barrel container 34, such as an aerosol can for cleaning products.

The collar 14 is generally sized and shaped to precisely fit over a valve rim 18 of an associated container 31 or 34. According to this aspect of the present invention, the collar 14 has an inner wall 32 defining an inner diameter which corresponds with the outer diameter of the valve rim 18 so that the collar 14 can be press fitted thereon. In a preferred embodiment of the present invention, the collar 14 includes a circumferentially arranged locking tab 16 which extends from the inner wall 32 thereof. The locking tab 16 is adapted to lock the collar on the valve rim 18 by engaging the undersurface thereof as disclosed in FIGS. 1 and 2. The operation of this feature of the present invention will be described in detail hereinbelow.

Figure 3:
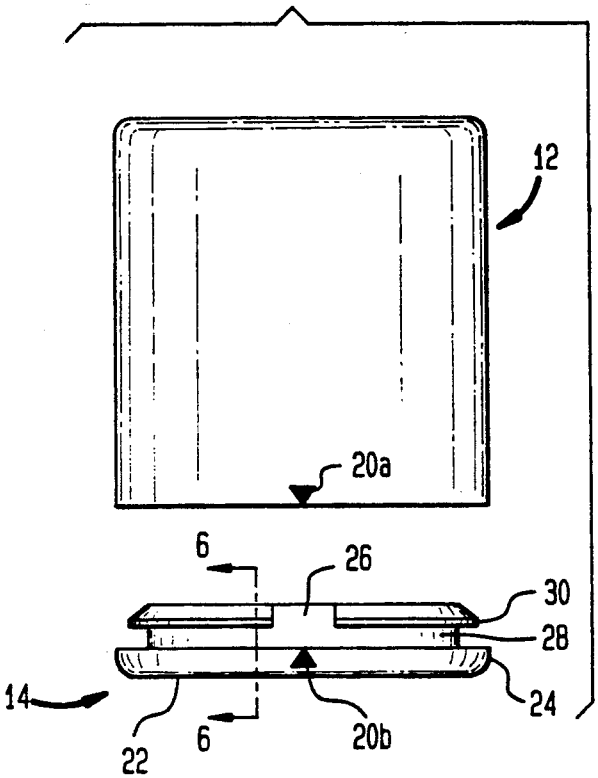
FIG. 3 is a front exploded view of the childproof cap shown in FIGS. 1 and 2.

The collar 14 includes an outer surface having a lower lip 24, an upper lip 30 and a radial groove 28 therebetween, all of which can best be appreciated as shown in FIG. 3. Additionally, a sized and shaped recess 26 is cut into the upper lip 30 and provides a passageway between the radial groove 28 and the top of the cap 14. This feature of the present invention is also clearly shown in FIG. 3.

It is desirable for the collar 14 to include a distinctive mark, such as arrow 20*b*, as part of an alignment mechanism which corresponds with a similar mark 20*a* on the cap 12 as will be discussed further below. The collar 14 also includes an internal shoulder 40 which is formed from the inner wall 32 and which extends a predetermined distance therefrom. The structure of the shoulder 40 is adapted to rest on the valve rim 18 when the collar is snapped into its assembled position on a pressurized container 31 or 34. This feature of the present invention is clearly illustrated in FIGS. 1, 2 and 7.

Figure 6:
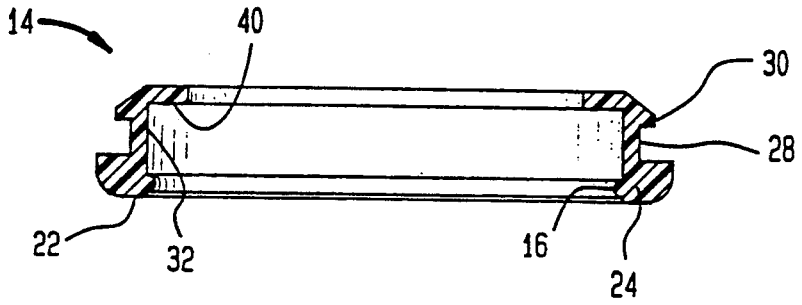
FIG. 6 is a cross-sectional view of the collar of the childproof cap shown in FIGS. 1-3.
Figure 7:
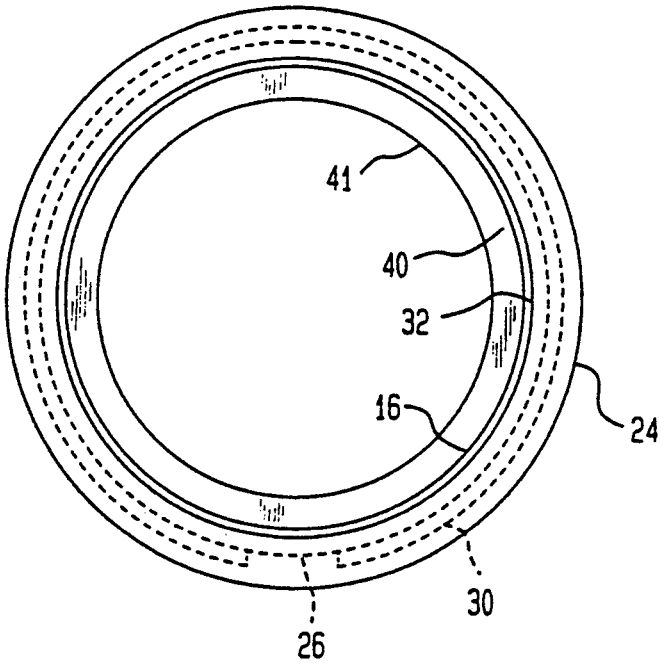
FIG. 7 is a top plan view of the collar of the childproof cap shown in FIGS. 1-3

The collar 14 also includes a bottom portion 22. The structure of the bottom portion 22 is an important feature of the present invention. As best shown in FIGS. 1, 2 and 6, the bottom portion 22 of the cap 14 is arranged at a predetermined spaced distance from the internal shoulder 40. This spaced difference is selected so that the barrel of the container 31 or 34 will not interfere with mounting of the collar 14 on the valve rim 18. Thus, as can be appreciated with reference to FIGS. 1 and 2, the structure of the collar 14 renders the present invention entirely universal. In other words, the present safety cap can be mounted on any container having an appropriately sized valve rim. The size of the barrel of the container is immaterial since the bottom portion 22 of the collar 14 is sized and shaped so that it will remain spaced from, or in the worst case, immediately adjacent, the barrel of the container 31 or the bulbous portion 36 of the container 34 when the internal shoulder 40 rests on the valve rim 18, i.e., when the collar 14 is in its assembled position.

Figure 4:
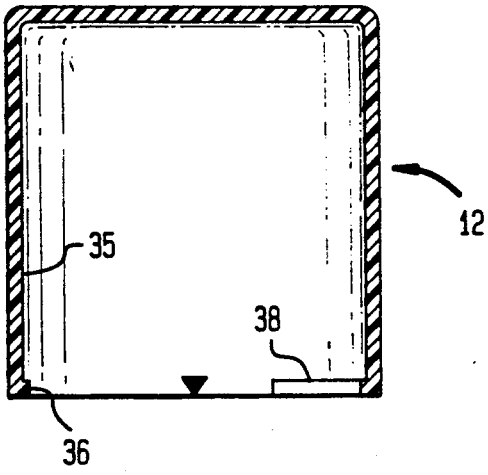
FIG. 4 is a front cross-sectional view of the cover of the childproof cap shown in FIGS. 1-3.
Figure 5:
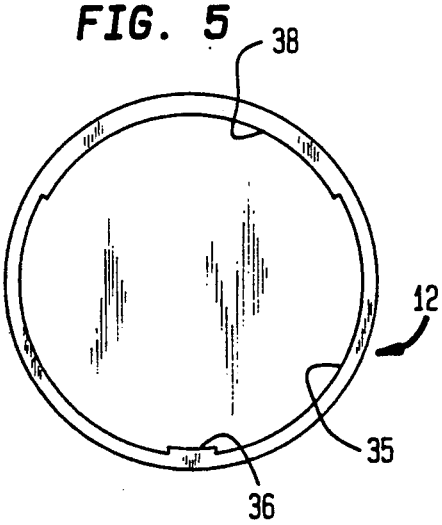
FIG. 5 is a bottom plan view of the cover of the childproof cap shown in FIGS. 1-3.

The cover, generally designated 12, according to a preferred embodiment of the present invention, comprises a cylindrical shell defining an inner surface 35 as shown in FIGS. 4 and 5. It is also preferable for the cap 12 to include a sized and shaped projection 36 extending from the inner surface 34 at the bottom of the cap. As can be appreciated with reference to FIGS. 3 and 4, the projection 36 is generally sized and shaped to fit within the passageway defined by the recess 26 of the collar 14. As also shown in FIGS. 4 and 5, the cover 12 includes a circumferentially arranged ridge 38 extending from the inner wall 34 opposing the projection 36.

In a preferred embodiment, the ridge 38 extends approximately one-third of the way around the inner circumference of the cap 12. However, the arc of the ridge 38 can be extended or shortened in alternate embodiments while remaining within the scope of the present invention. The ridge 38 is preferably sized and shaped to fit within the radial groove 28 of the collar 14 as will be described further hereinbelow. It is also 20 preferable for the cap 12 to include a mark, such as the arrow 20*a*, as shown in FIG. 3. The arrow 20*a* is designed to correspond with the arrow 20*b* of the collar 14 and thus serves as an alignment device for proper operation of the safety cap 10 of the present invention.

The collar 14 and the cover 12 are preferably made of a polymer or plastic material such as POLY-PRO. However, many substitute materials can be used to manufacture these components of the safety cap 10 of the present invention. In a particularly preferred embodiment of the present invention, the distance between the lower surface of the inner shoulder 40 and the bottom surface of the collar 14 is between about 0.200–0.250 inches. The size of the recess 26 between the upper lip 30 of the collar 14 is about 0.285–0.315 inches. The radial groove 28 between the lower lip 24 and the upper lip 30 is preferably about 0.063–0.093 inches. The diameter of the inner wall 32 of the collar 14 is preferably between about 1.268–1.298 inches. It should be appreciated that the foregoing preferred dimensions are approximate and are pertinent when a standard sized valve rim, such as a valve rim having an outer diameter of about 1.29 inches, is used on the associated containers. Of course, if a valve rim having a larger or smaller outer diameter is used, the corresponding diameter of the inner wall 32 of the collar 14 will vary accordingly. In an alternate preferred embodiment, the collar 14 may include a plurality of crush ribs (not shown) arranged on the inner wall 32 to create a tighter fit between the collar 14 and the valve rim 18. The crush ribs also facilitate the manufacturing process of the collar 14 by increasing tolerancing requirements of the diameter of the inner wall 32 thereof.

With regard to the cover 12, it is preferable for the projection 36 to extend along the inner wall 34 a distance of about 0.200 inches. The arc of the ridge 38 extends approximately one-third of the way around the wall 34 and preferably encompasses a range of about 130° out of the entire 360° circle. In a most preferable embodiment, the projection 36 and the ridge 38 extend between about 0.53–0.83 inches from the bottom of the cover 12 towards the top thereof. As can be appreciated, the size and shape of the projection 36 and the ridge 38 must be selected so that these portions of the cover 12 can adequately correspond with the recess 26 and the groove 28 of the collar 14.

In operation, the cover 14 is first pressfitted over the valve rim 18 of an associated container. When the collar 14 is arranged in its assembled position, the circumferentially arranged locking tab 16, which extends from the inner wall 34, becomes arranged beneath the valve rim 18 so that the collar 14 is securely mounted thereon. The collar 14 has a circular opening 41 arranged about the top thereof so that a dispensing mechanism from an associated container can extend therethrough. As can be appreciated, the size and shape of the opening 41 must be sufficient to permit the dispensing mechanism of an associated container to extend therethrough. However, the precise size and shape of the opening 41 is not a critical feature of the present invention.

In its assembled form, the cover 12 is placed on the collar 14 so that the arrows 20*a* and 20*b* are aligned as shown in FIG. 1. At this time, the projection 36 is aligned with the recess 26 in the collar 14 and the ridge 38 is arranged within the groove 28. The cover 12 can be freely rotated in a radial direction, both clockwise and counterclockwise, when it is properly seated on the collar 14. However, the cover 12 can only be removed from collar 14 when the arrows 20*a* and 20*b* are aligned or are nearly aligned.

When the arrows 20*a* and 20*b* are arranged in an offset position, the cover 12 is securely locked onto the collar 14 as a result of the interlocking relationship between the projection 36 and the ridge 38 of the cover 12 and the groove 28 of the collar 14. As can be appreciated, when an individual desires to prevent young children from gaining access to the contents of a container, the cover 12 is twisted in relation to the collar 14 so that the arrows 20*a* and 20*b* are misaligned as described above. Unless a young child is taught how to do so, he or she will generally not have the intuitive knowledge to determine that the inconspicuous arrows 20*a* and 20*b* must be aligned before the cap can be removed from the collar. Thus, the safety cover 10 of the present invention effectively serves as a childproof device.

The structure of the present invention is particularly desirable since it can be universally used with containers having varying barrel diameters, such as containers 31 and 34 shown in FIG. 1 and 2, respectively. This is an important feature of the present invention and is generally attributable to the specific structure and arrangement of the new collar 14. This universality feature of the present invention makes it extremely attractive to commercially market the present invention to the general public after they have purchased various products which are potentially dangerous and which are stored within containers having a valve rim as described hereinabove.

The foregoing description and figures are directed toward preferred embodiments in accordance with the present invention. However, it should be appreciated that numerous modifications can be made to each of the components of the present childproof safety cap as discussed above. Indeed, such modifications are encouraged to be made in the materials and structure of the disclosed embodiments of the present invention without departing from the spirit and scope thereof. Accordingly, the foregoing description of the preferred embodiment should be taken by way of illustration rather than by way of limitation of the present invention as defined by the following claims.

I claim:

1. A two-piece safety cap for a container including a valve assembly having a valve rim thereon, said cap comprising:

a collar having an inner surface and an outer surface and a top portion and a bottom portion, said collar securably seatable on said valve rim so that said inner surface is arranged adjacent said valve rim, said bottom portion being sized and shaped so that said collar can be seated on said valve rim independent of the diameter of the container adjacent said valve rim without any interference occurring between said bottom portion and said container;

a cover mountable on said collar in a removable position and also in a non-removable position, said outer surface of said collar comprising a circumferentially arranged groove, said groove being sized and shaped to receive a portion of said cover therein, and recess means for permitting said cover to be mounted on said collar and removed therefrom, said recess means being arranged on said outer surface of said collar, said cover comprising a ridge and a projection, said ridge and said projection extending from said inner surface of said cover, said ridge being adapted to be mounted within said groove of said collar and said projection being sized and shaped to fit within said recess means of said collar, said cover being rotatably mounted on said collar so that said projection can rotate into said groove; and locking means for locking said cover on said collar when said cover is in said non-removable position, said locking means comprising a combination of said groove of said collar and said ridge and said projection of said cover.

2. The safety cap of claim 1 further comprising alignment means for providing an indication when said cover is arranged in said removable position and said non-removable position with respect to said collar.

3. The safety cap of claim 1 wherein said cover comprises an inner surface, said inner surface being arranged adjacent said outer surface of said collar when said cover is mounted on said collar.

4. The safety cap of claim 1 wherein said collar further comprises a locking tab, said locking tab being circumferentially arranged on said inner surface and is adapted to engage said valve rim when said collar is mounted thereon so that said collar cannot be readily removed therefrom.

5. The safety cap of claim 1 wherein said collar further comprises an internal shoulder, said shoulder extending from said inner surface and being adapted to rest directly upon said valve rim when said collar is mounted thereon.

6. The safety cap of claim 1 further comprising alignment means for providing an indication when said cover is arranged in said removable position and said non-removable position with respect to said collar.

7. The safety cap of claim 5 wherein said alignment means comprises a plurality of distinguishing marks, said distinguishing marks being arranged on said collar and said cover to indicate when said projection of said cover is aligned with said recess of said collar.

* * * * *